United States Patent [19]

Ono et al.

[11] 4,389,165

[45] Jun. 21, 1983

[54] ION PUMP FOR PRODUCING AN ULTRAHIGH DEGREE OF VACUUM

[75] Inventors: Shoichi Ono; Kuniyoshi Yokoo, both of Sendai, Japan

[73] Assignee: Tohoku University, Sendai, Japan

[21] Appl. No.: 190,913

[22] Filed: Sep. 26, 1980

[30] Foreign Application Priority Data

Sep. 29, 1979 [JP] Japan ..... 54-124716

[51] Int. Cl.[3] ..... F04B 37/02

[52] U.S. Cl. ..... 417/49; 313/7; 315/111.91

[58] Field of Search ..... 417/48, 49; 313/7, 161, 313/103, 104; 315/39, 111.91

[56] References Cited

U.S. PATENT DOCUMENTS 3,198,422 8/1965 Kienel ..... 417/49
3,274,436 9/1966 Reich ..... 313/7 X
3,521,146 7/1970 Forrer ..... 313/104 X
3,542,488 11/1970 Hall ..... 417/49
3,543,135 11/1970 O'Brien et al. ..... 313/104 X

*Primary Examiner*—Edward K. Look
*Attorney, Agent, or Firm*—Fleit, Jacobson & Cohn

[57] ABSTRACT

An ion pump for producing an ultrahigh degree of vacuum comprising a space formed between a first perforated flat plate-shaped electrode and a second flat plate-shaped electrode and having a high frequency electric source connected between the first and second electrodes, said space being operative to induce multipactor effect between said first and second electrodes, and an ionization space adjacent to one of said first and second electrodes and formed between a first perforated getter electrode and a second getter electrode applied with a negative potential, said ionization space being operative to cause the moving electrons produced by the multipactor effect to collide with gas molecules and ionize the latter.

7 Claims, 5 Drawing Figures

ION PUMP FOR PRODUCING AN ULTRAHIGH DEGREE OF VACUUM

BACKGROUND OF THE INVENTION

1. Field of the Invention

This invention relates to vacuum pumps and more particularly to an ion pump for producing an ultrahigh degree of vacuum.

2. Description of the Prior Art

An ion pump has heretofore been used in general for the purpose of exhausting air or other gas from an enclosed space for experimental apparatus, manufacturing apparatus in electronic industry or the like to a high degree of vacuum of at least $10^{-6}$ Torr without polluting the space with oil vapor or the like. In the ion pump, moving electrons in a high electric field collide with gas molecules in the high electric field to ionize the gas molecules to produce ions. The ions thus produced collide with the electrode formed of titanium or the like and having a getter action and one portion of the ions is captured by the electrode. In this case, the energy produced during the collision of the ions with the titanium electrode causes the atom of titanium or the like to spatter and the atom spattered is continuously adhered to the other electrode having a large surface area. The above mentioned capture of one portion of the ions produced and adsorption of gas molecules due to the spattering of the titanium atom or the like function to exhaust air or other gas from the enclosed space to a desired degree of vacuum.

A conventional ion pump has the drawback that as the degree of vacuum in the enclosed space becomes high the exhaust speed becomes extremely low. If the exhaust speed becomes low, it takes not only a long time to exhaust air or other gas from the enclosed space to a desired degree of vacuum but also a vital drawback that a degree of vacuum to be obtained in an exhaust system as a whole becomes low. The cause of extremely lowering the exhaust speed is as follows. If the degree of vacuum becomes high, the means free path of the moving electrons becomes long to decrease the probability of ionizing the gas molecules per one electron, and as a result, the number of electrons contributing to the successive ionization is decreased. This is due to the fact that there occurs a negative feedback action in the course of producing ions.

In the conventional ion pump, in order to improve the ionization probability per one electron, a magnetic field is applied to a space in which the electrons are moving so as to cause the electrons to effect their rotary motion and make the travelling distance of the electron long. But, it has been impossible to eliminate the above mentioned negative feedback action.

SUMMARY OF THE INVENTION

An object of the invention, therefore, is to provide an ion pump for producing an ultrahigh degree of vacuum which can exhibit a multipactor effect, i.e., a sort of high frequency discharge phenomenon under a high degree of vacuum, which can extremely increase the number of electrons per unit volume of an enclosed space and hence can make the exhaust speed high and eliminate the above mentioned negative feedback action and which does not make the exhaust speed low even under a high degree of vacuum.

A feature of the invention is the provision of an ion pump for producing an ultrahigh degree of vacuum comprising first and second electrodes opposed to each other to form a space therebetween and having a desired secondary electron emission ratio, a high frequency electric source connected between the first and second electrodes which applies a high frequency electric field therebetween so as to accelerate electrons produced from one of the first and second electrodes and cause the electrons thus accelerated to collide with the other electrode to emit secondary electrons which are then accelerated toward the other one of the electrodes whereby a secondary electron resonance multiplication phenomenon, i.e., multipactor effect is obtained, and means for forming an ionization space adjacent to one of the first and second electrodes and operative to take in one portion of moving electrons produced by the multipactor effect and cause the moving electrons to collide with gas molecules and ionize the latter.

Further objects and features of the invention will be fully understood from the following detailed description with reference to the accompanying drawings, wherein:

BRIEF DESCRIPTION OF THE DRAWINGS

FIG. 1(*b*) is a ground biasing circuit for one of the getter electrodes of FIG. 1(*a*).

FIG. 2(*b*) is a diagrammatic cross-sectional view of another embodiment of an ion pump employing a portion of a rectangular wave guide as a portion of the evacuating chamber.

FIG. 2(*c*) is a perspective, partially cross-sectional view of the wave guide used in FIG. 2(*a*).

DETAILED DESCRIPTION OF THE PREFERRED EMBODIMENTS

As described above, an ion pump for producing an ultrahigh degree of vacuum according to the invention makes use of the multipactor effect which will now be described.

Let it be assumed that a high frequency voltage V having a frequency f is applied to a system composed of two opposed flat plate-shaped electrodes spaced apart from each other by a distance d. In this case, even if few electrons are present between the electrodes, these electrons are accelerated by the high frequency electric field and collide with one of the electrodes at a certain speed to emit secondary electrons from this electrode. If the high frequency electric field reverses its phase, the secondary electrons are accelerated in a reverse direction and collide with the other electrode, thereby emitting secondary electrons again from the other electrode.

Now, let it be assumed that the secondary electrons emitted from one of the electrodes collide with the other electrode after the lapse of time of $\frac{1}{2}$, 3/2, 5/2 . . . times the high frequency period and that the collision speed has such a value that the secondary electron emission factor $\delta$ of the electrode is at least 1, the number of the secondary electrons emitted from the electrode is increased to $\delta^n$ times when nth collision has finished. It is a matter of course that if the above mentioned condition is maintained, a very large number of secondary electrons would be emitted from the electrode after the lapse of an infinitely long time.

In practice, however, as the number of the emitted electrons is increased, the space charge effect becomes increased. The space charge effect thus increased causes the collision speed to change from the initial collision speed and causes the phase of the high frequency electric field to displace in the successive high frequency electric field. As a result, the number of the secondary electrons reaches an equilibrium condition under which certain number of the secondary electrons are present. This is the principle of the multipactor effect, i.e., the secondary electron resonance multiplication effect. This multipactor effect causes a high frequency power loss in a high electric power microwave guide or the like. Many attempts have been made to eliminate such high frequency electric power loss due to the multipactor effect. As can be seen from the above, the multipactor effect is a phenomenon which is comparable with a usual discharge phenomenon under low degree of vacuum which provides a considerably large electron multiplication.

Figure 1:
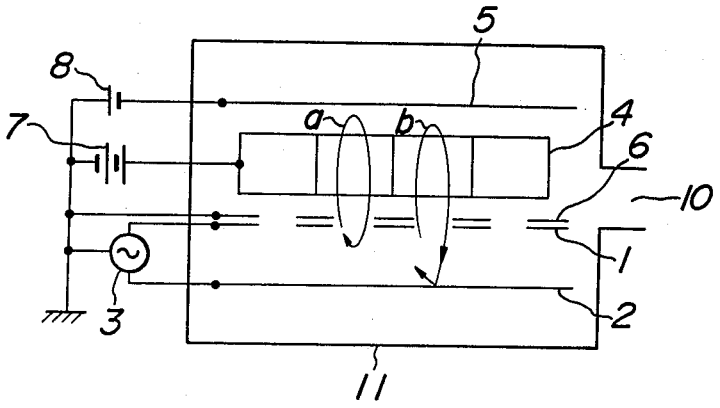
FIG. 1(*a*) is a diagrammatic view of one embodiment of an ion pump for producing an ultrahigh degree of vacuum according to the invention.

FIG. 1 shows one embodiment of an ion pump for producing an ultrahigh degree of vacuum according to the invention. Referring to FIG. 1, reference numeral 1 designates a perforated flat plate-shaped electrode provided with one or a number of small holes. Between the perforated flat plate-shaped electrode 1 and an opposed flat plate-shaped electrode 2 is connected a high frequency electric source 3 so as to produce the above mentioned multipactor effect between these electrodes. These electrodes may be formed of material having a large secondary electron emission factor $\delta$ and selected from such a group consisting of aluminum (Al), a silver-magnesium alloy (Ag-Mg), a magnesium oxide (MgO), and magnesium fluoride ($MgF_2$).

But, those portions of the electrodes which are required to have a large $\delta$ value are limited to the opposed surfaces only of these electrodes, so that the electrodes may be composed of suitable metal substrates whose opposed surfaces only are coated with this films formed of the above mentioned material.

If the multipactor effect occurs, a number of electron groups continuously reciprocate between the electrodes 1, 2. One portion of the electron group is diffused and emitted through the holes of the perforated flat plate-shaped electrode 1 and then accelerated by the direct current potential applied from a direct current source 7 to a grid-shaped electrode 4. The electrons thus accelerated are added to an electron group spirally moving in the magnetic field in the manner similar to the conventional ion pump, whereby the residual gas in the pump space is ionized so as to increase probability of forming a pair of ion and electron. The ion thus produced is accelerated by the direct current source 7 and collides with a getter electrode 5 and a perforated getter electrode 6 having small holes and disposed on the perforated flat plate-shaped electrode 1. Similar to the conventional ion pump, the getter electrodes 5, 6 are formed of titanium or the like having a getter action and function to seize one portion of ions and spatter atoms of titanium or the like. The atom thus spattered is adhered to the side surface of the grid-shaped electrode 4 and to the inner surface or the like of a vacuum chamber 11, thereby continuously producing a gas molecule adsorption surface having a large area and effecting exhaustion of the vacuum chamber 11. The vacuum chamber 11 is provided with a vacuum supply opening 10 and magnet 12.

Those electrons supplied by the multipactor effect which have an energy and enter through the holes of the perforated flat plate-shaped electrode 1 into the pump space are seized by the getter electrode 5 to stop their return movement. As a result, these electrons do not make a great contribution to the ionization. On the contrary, the electrons produced in the pump space can make a number of reciprocal motions.

In the present embodiment, to the getter electrode 5 is applied a negative potential from a direct current electric source 8. The use of such measure ensures a reciprocal motion of the electrons supplied by the multipactor effect in the same manner as the electrons produced in the pump space, thereby making a great contribution to the ionization.

That is, the electrons emitted through the holes of the perforated flat plate-shaped electrode 1 and spirally moving to the getter electrode 5 are repelled by the negative potential applied to the getter electrode 5 and follow the same track again, thereby entering through the holes of the electrode 1 into the multipactor discharge space. In the multipactor discharge space, the electrons shown by a in FIG. 1 are decelerated and returned through the holes of the electrode 1 again to the pump space, thereby ionizing the residual gas molecule whilst reciprocally moving the electrons in the same manner as the electrons in the conventional ion pump.

On the one hand, the electron accelerated by the high frequency electric field collides with the lower electrode 2 as shown by an arrow b in FIG. 1 and contributes to produce the electrons due to the multipactor effect and supplement them again.

Heretofore, a method of artificially supplying secondary electron by $\beta$ ray illumination from radiation isotope into a pump space for the purpose of improving an exhaust speed and starting characteristic under an ultrahigh degree of vacuum has been proposed. Such method has the drawback that it is difficult to supply a plane-like and high density electron group contrary to the multipactor effect and that the above mentioned reciprocating motion of the electron thus supplied could not be obtained, thereby giving no effective contribution to the ionization of the gas molecule.

On the contrary, the electrons supplied by the multipactor effect is subjected to the reciprocating motion and is fed back to the multipactor effect, and as a result, the supply of electron having a high density can be maintained. As can be seen from the above, one of the features of the operation of an ion pump for producing an ultrahigh degree of vacuum according to the invention is that the ionization probability can be made large even under the ultrahigh degree of vacuum.

In addition, if the getter electrode 5 is connected through a suitable resistor 13 to ground, as shown in FIG. 1(*b*), the negative potential for repelling the electron supplied thereto is automatically produced by the electron group having a high energy and entering into the electrode 5, so that the direct current source 8 may be omitted. In addition, a capacitance C between the flat plate-shaped electrodes 1, 2 for inducing the multipactor effect and a suitable inductance L constitute an electric circuit which is resonant with a high frequency voltage and which can produce a large high frequency voltage from a small electric power source.

Figure 2:
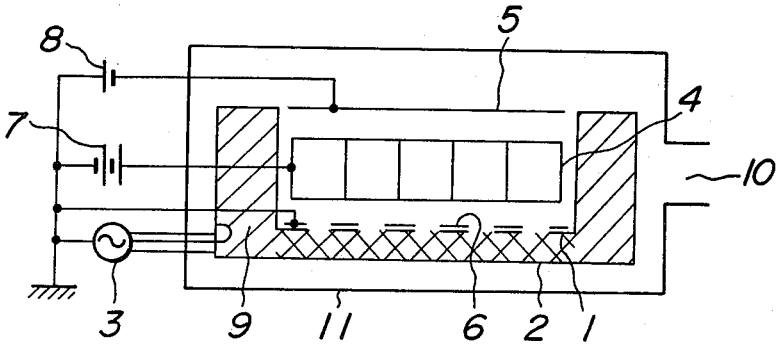
FIG. 2(*a*) is a diagrammatic cross-sectional view of another embodiment of an ion pump for producing an ultrahigh degree of vacuum according to the invention.
Figure 1A:
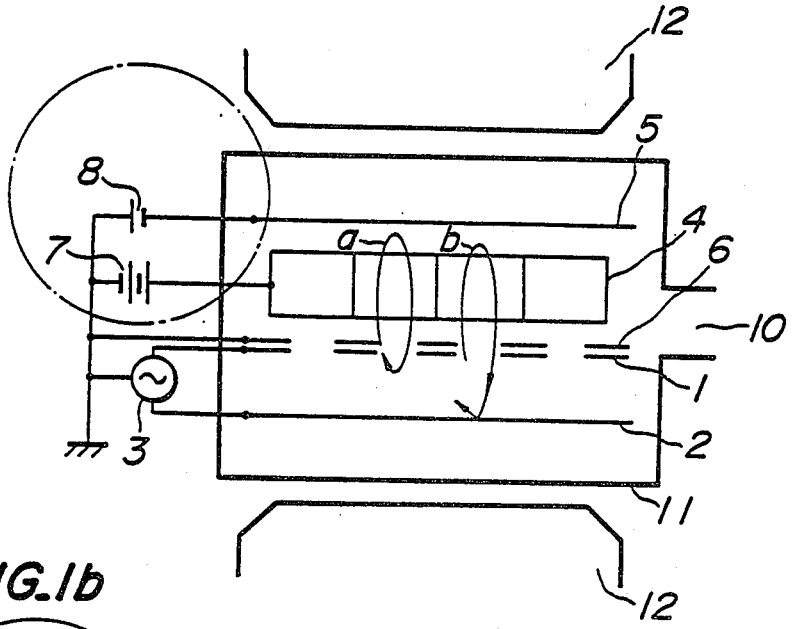
Figure 1B:
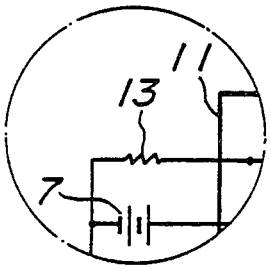
Figure 2A:
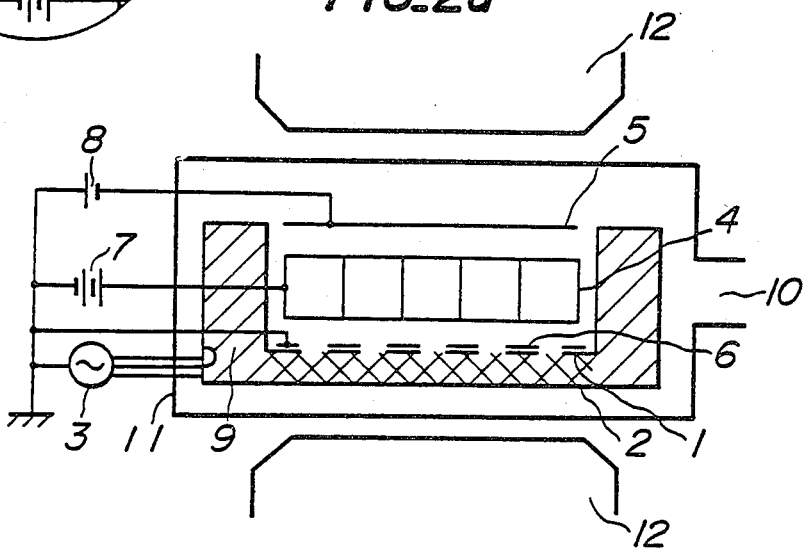
Figure 2B:
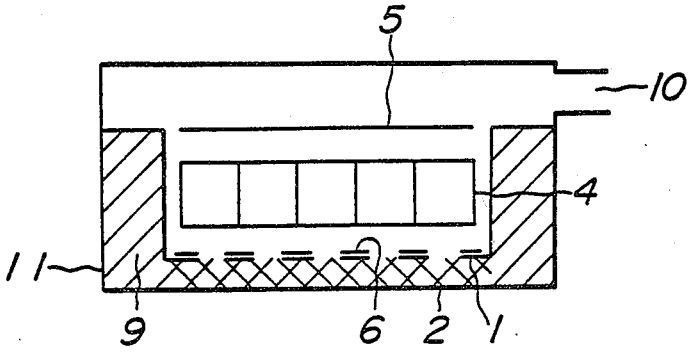
Figure 2C:
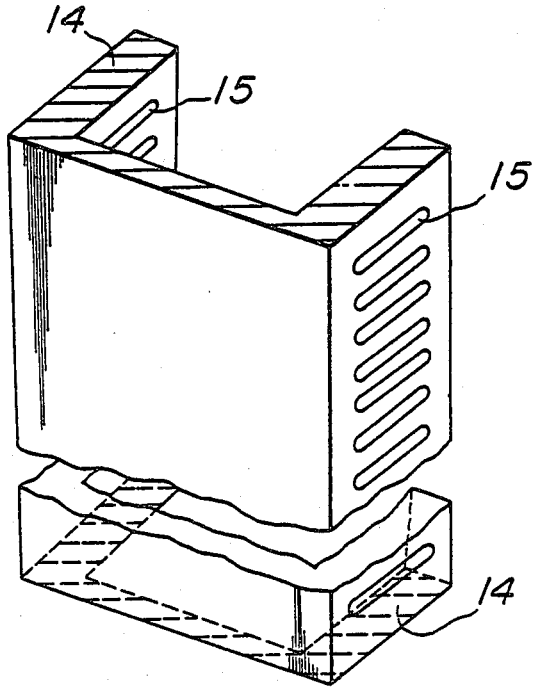

FIG. 2 shows another embodiment of an ion pump for producing a ultrahigh degree of vacuum according to the invention which makes use of a cavity resonator. In the present embodiment, use is made of a high frequency cavity resonator composed of a rectangular wave guide provided with a ridge. In FIG. 2, reference numeral 11 designates a rectangular vacuum chamber provided with a vacuum supply opening 10 which is connected to an apparatus to be evacuated to a high degree of vacuum. A hatched portion 9 designates a cavity resonator composed of a rectangular wave guide provided with a ridge. If the length of the resonator is made large, it is possible to provide a vacuum pump having a high exhaust speed. To the cavity resonator 9 is supplied a high frequency power whose frequency is equal to the resonance frequency. In this case, a high frequency electric field is produced in that portion of the resonator 9 which is cross hatched and constitutes the capacitance C thereof, thereby inducing the multipactor effect between the electrodes 1, 2. As above mentioned, the electrode 1 is provided with small holes and the electrons produced due to the multipactor effect are diffused and flow upwardly through those small holes and then are accelerated by the direct current source 7, thereby ionizing the residual gas in the chamber 11. The ions produced are caught by the electrodes 5, 6 formed of titanium or the like having the getter action. Moreover, it is possible to spatter the atom of titanium or the like by the ions produced, thereby adsorbing the gas molecules and effecting exhaustion. As shown in FIG. 2(*b*), wave guide for constituting the resonator is provided at its side surface with a number of holes 15 adapted to cause the gas molecules to enter into the resonator in an easy manner. As shown in FIG. 2(*c*), the outer shell of the cavity resonator 9 may be formed by one portion of the vacuum chamber 11 as shown in FIG. 2(*b*).

As stated hereinbefore, an ion pump for producing an ultrahigh degree of vacuum according to the invention has a number of advantages. In the first place, the ion pump according to the invention can obtain an exhaust speed under an ultrahigh degree of vacuum condition which is extremely high if compared with a conventional ion pump. Secondly, the ion pump according to the invention can be used for exhaustion of the apparatus of all kinds of fields which are required to be evacuated to a pure ultrahigh degree of vacuum inclusive of experimental apparatus, manufacturing apparatus for electronic industry or the like. Third, the ion pump according to the invention is composed of a conventional ion pump added with a space for inducing a multipactor effect and hence can operate not only as a conventional ion pump in the case of producing a low degree of vacuum but also as an ion pump according to the invention in the case of producing an ultrahigh degree of vacuum by turning on the high frequency electric source and hence by inducing the multipactor effect. Finally, during discharging of the conventional ion pump, the number of electrons which can ionize the residual gas molecules is decreased as the gas pressure becomes low so that in the ultrahigh vacuum region of lower than $10^{-8}$ Torr the exhaust speed becomes considerably low or the discharge is extinct or the start of discharge becomes difficult. The ion pump according to the invention functions to always supply a great number of electrons through the holes of the electrode due to the multipactor effect even under an extremely high degree of vacuum, and as a result, the above mentioned negative feedback action is not induced, the exhaust speed is not so much lowered, the discharge is not extinct, and it is possible to start the discharge in an easy manner.

What is claimed is:

1. An ion pump for producing an ultrahigh degree of vacuum comprising:

an evacuating chamber disposed in a magnetic field, a first perforated multipactor electrode and a second multipactor electrode opposed to each other to form a multipactor space therebetween in said chamber, said electrodes having a desired secondary electron emission ratio, a high frequency electric source connected between said first and second electrodes for generating a high frequency alternating current electric field therebetween so as to accelerate electrons produced by one of said first and second multipactor electrodes and to cause said electrons thus accelerated to collide with the other electrode to emit secondary electrons whereby a secondary electron resonance multiplication phenomenon is obtained, an ionization space disposed adjacent to said multipactor space, said ionization space being defined by a first perforated getter electrode adapted to receive a first direct current potential and a second getter electrode adapted to receive a second direct current potential for repelling ions, said ionization space being disposed adjacent said first perforated multipactor electrode, and including therein an accelerating grid electrode for accelerating ions from said first to said second getter electrodes whereby said ionization space is operative to take in a portion of moving electrons produced in said multipactor space and to cause moving electrons to collide with and ionize gas molecules thereby to evacuate the chamber.

2. The ion pump according to claim 1, wherein said means for forming an ionization space is composed of getter electrodes which are applied with a suitable potential so as to cause one portion of said moving electrons in said ionization space to return to said space formed between said first and second electrodes.

3. The ion pump according to claim 1, wherein said first electrode is composed of a perforated flat plate-shaped electrode provided with at least one small hole and said second electrode is composed of a flat plate-shaped electrode, said first and second electrodes being formed of material having a large secondary emission factor and selected from such a group consisting of aluminum, silver-magnesium alloy, magnesium oxide and magnesium fluoride.

4. The ion pump according to claim 3, wherein said first and second electrodes are composed of metal substrates whose opposed surfaces only are coated with their films formed of said material.

5. The ion pump according to claim 1, wherein said ionization space is adjacent to said first electrode and composed of a first perforated getter electrode having small holes and a second getter electrode to which is applied a negative potential, said first and second getter electrodes being formed of titanium having a getter action.

6. The ion pump according to claim 5, wherein said second getter electrode opposed to said first perforated getter electrode is connected through a resistor to ground.

7. An ion pump for producing an ultrahigh degree of vacuum comprising:

an evacuating chamber disposed in a magnetic field, a multipactor space defined by a first perforated multipactor electrode and a second multipactor electrode opposed to each other, each electrode having a desired secondary electron emission ratio, a high frequency electric source connected between said first and second multipactor electrodes for generating a high frequency alternating current electric field therebetween so as to accelerate electrons produced from one of said first and second multipactor electrodes and cause said electrons thus accelerated to collide with the other electrode to emit secondary electrons therefrom, an ionization space disposed adjacent to said multipactor space, said ionization space being defined by a first perforated getter electrode adapted to receive a first direct current potential and a second getter electrode adapted to receive a second direct current potential for repelling ions, said ionization space being disposed adjacent said first perforated multipactor electrode and including therein an accelerating grid electrode for accelerating ions from said first to said second getter electrodes, a rectangular wave guide provided with ridges being formed between said first and second multipactor electrodes, whereby a secondary electron resonance multiplication phenomenon is obtained, said ionization space being operative to take in a portion of the moving electrons produced in said multipactor space and to cause said moving electrons to collide with and ionize gas molecules.

* * * * *